United States Patent [19]

Walton

[11] 4,134,241

[45] Jan. 16, 1979

[54] INSULATED BUILDING BLOCK

[75] Inventor: Robert J. Walton, Scottsdale, Ariz.

[73] Assignee: Energy Block Ltd., Scottsdale, Ariz.

[21] Appl. No.: 813,736

[22] Filed: Jul. 7, 1977

[51] Int. Cl.[2] ..... E04B 2/00; E04B 5/04

[52] U.S. Cl. ..... 52/275; 52/405; 52/574

[58] Field of Search ..... 52/275, 574, 405, 404, 52/438, 309.3, 309.5, 743, 747

[56] References Cited

U.S. PATENT DOCUMENTS

| | | | |
|---|---|---|---|
| 3,222,830 | 12/1965 | Ivany | 52/438 |
| 3,546,833 | 12/1970 | Perreton | 52/405 |
| 3,593,480 | 7/1971 | Bouchillon | 52/309.3 |
| 3,780,484 | 12/1973 | Muse | 52/438 X |
| 3,998,022 | 12/1976 | Muse | 52/574 |
| 4,002,002 | 1/1977 | Barnhardt | 52/405 |
| 4,016,693 | 4/1977 | Warren | 52/405 |
| 4,018,018 | 4/1977 | Kosuge | 52/404 |
| 4,027,445 | 6/1977 | Nickerson | 52/405 |

FOREIGN PATENT DOCUMENTS

| | | | |
|---|---|---|---|
| 470407 | 4/1952 | Italy | 52/609 |

*Primary Examiner*—J. Karl Bell

*Attorney, Agent, or Firm*—Geoffrey R. Myers; William D. Hall

[57] ABSTRACT

A hollow building block filled with insulation is shaped as a pair of proximal but offset rectangles thereby to form steps at diagonal corners for fitting adjoining blocks together. A continuous insulation effect is obtained because the insulation in each rectangle extends beyond that of its proximal rectangle and overlaps with the insulation in the proximal rectangle of each adjoining block. Aligning holes and reinforcing grooves are provided for rapidly constructing strong structures from the blocks.

23 Claims, 4 Drawing Figures

INSULATED BUILDING BLOCK

This invention relates to building blocks. More particularly, this invention relates to unique building blocks which contain insulation in a manner such that when the blocks are assembled into a wall structure, a continuous insulation effect is achieved.

Increased energy costs have brought on the need to find better ways of insulating buildings. The conventional technique currently employed in the building trades is to add insulation to the inner wall surfaces, usually between wall struts, thereby to achieve, except for the width of the strut, a continuous insulation effect across the breadth of the wall. Drawbacks associated with this approach are that the insulation consumes space otherwise useful as room space, the labor costs involved in installing such insulation increase the cost of the home, and the effective thickness of the insulation is often less than desired.

Several attempts have been made to mitigate these problems. One has been to place the insulation in the outside wall of the building itself, thus either eliminating the need for or reducing the amount of insulation needed on the inside of the wall. Placing the insulation within the outer wall of the building has been attempted in basically two ways. The first is to pump insulation into the holes, hollows or crevices of the outside wall. Exemplary of this is the RAPCO-FOAM technique by Rapperswill Corporation of New York City, N.Y. In this technique insulation such as urea-formaldehyde is foamed in situ after being pumped into crevices or through holes drilled in an outer wall, by an applicator gun.

In the second technique hollow building blocks of various shapes and configurations which make up the outer building wall are filled with insulation (vermiculite, aluminum foil, polystyrene, urethane, urea-formaldehyde, styrofoam, fiberglass, and the like). In addition, various techniques have been used to connect or stack blocks together for better fit and more accurate stacking. The use of grooves, offset shapes and the like are among the techniques conventionally employed.

In addition to the rather complex nature of some of the prior art blocks is the fact that in most instances a continuous insulation effect is not achieved when they are filled with insulation. The term "continuous insulation effect" means that any straight vector heat flow striking the wall will always meet insulation regardless of what point on the wall the vector seeks to go through in a straight line. While a few techniques report achieving such an effect such as by an overlapping individual baffle effect, of the spot insulation or separate blocks, others leave substantial distances, such as the joints, where no insulation is present.

It is apparent from the above that there exists a need in the art for a building block and wall construction produced therefrom which achieves a continuous insulation effect and which at the same time is readily secured within the wall to its surrounding blocks, but whose construction is not so complex as to make it economically unfeasible to produce. It is also important that, at certain times, such blocks and walls be of high strength and thus capable of being readily reinforced. It is further important at certain times that such blocks be formed in such a manner as to be readily assembled into a wall construction without excessive time and labor.

It is a purpose of this invention to fill these needs in the art as well as other needs apparent to the skilled artisan once given the following description of the invention:

Generally speaking this invention provides for use by the building trades, a hollow construction block filled with insulation, which when assembled into a wall structure will provide a continuous insulation effect. The block contemplated is a walled shell substantially filled with insulation, said walled shell generally comprising a pair of laterally spaced opposing side walls offset longitudinally one from the other, a pair of opposing end walls for each side wall and extending from the ends thereof, and a joining wall connecting each pair of adjacent end walls across the distance of offset, said distance of offset being greater than the thickness of the end walls.

In certain embodiments the blocks may be provided with various optional features which enhance the insulating effect, reinforce the blocks, and/or make the blocks more readily formed into a wall structure. For example, in one embodiment the juncture of the joining wall and end wall at the inner end of the offset is enlarged and there is provided an orifice for retaining an aligning and/or reinforcing bar. Grooves may also be provided in the surfaces of the ends of the blocks for reinforcing bars.

The walls of this invention are readily formed in one embodiment by stacking the blocks such that each offset fits into the offset of the next adjacent block. The blocks may be secured with adhesive or mortar individually as they are stacked or upon stacking the entire wall, and where the insulation is itself an adhesive and the blocks are precision made, the insulation pumped into the hollows of the stack to thereby bond the blocks into a stable wall. The walls thus formed present a face to the environment which has a continuous insulation effect.

This invention will now be described with respect to certain embodiments and illustrations wherein:

IN THE DRAWINGS

Figure 1:
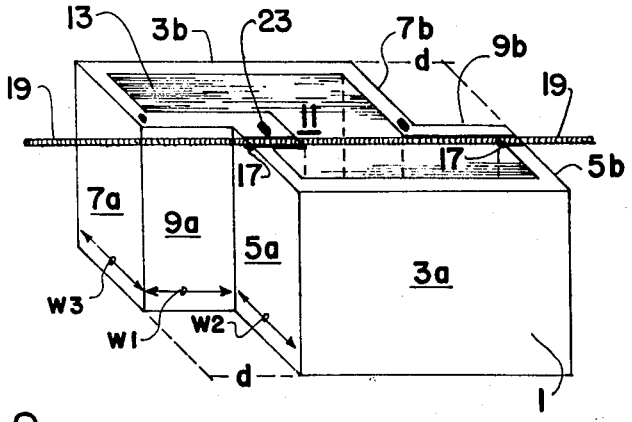
FIG. 1 is a perspective view of an embodiment of a block according to this invention.

With reference to the drawings, FIG. 1 illustrates one embodiment of a block as contemplated by this invention. As illustrated the block is an eight sided continuous walled shell 1 formed of two laterally spaced opposing side walls 3*a* and 3*b* offset longitudinally one from the other a finite distance "d". Walls 3*a* and 3*b* are essentially parallel.

Extending from the ends of wall 3*a* toward the plane of wall 3*b* is a pair of opposing end walls 5*a* and 5*b*. In a like manner, wall 3*b* has extending from its ends toward the plane of wall 3*a*, a pair of opposing end walls 7*a* and 7*b*. The ends of adjacent end walls 5*a* and 7*a*, opposite the ends attached to their respective walls 3*a* and 3*b*, are connected across the distance of offset "d" by joining wall 9*a*. Likewise, the ends of adjacent end walls 5*b* and 7*b*, opposite the ends attached to their respective walls 3*a* and 3*b*, are connected across the distance of offset "d" by joining wall 9*b*.

Preferably and as illustrated, walls 9*a* and 9*b* are parallel and lie in the same plane. In addition, all walls 5*a*, 5*b*, 7*a* and 7*b* are parallel and are perpendicular to walls 3a, 3b, 9a and 9b. In addition, the outer width "w", of walls 9a and 9b is equal to the outerwidth $w_2$ of walls 5a and 5b and the outer width $w_3$ of walls 7a and 7b.

Shell 1 is open at its top and bottom. The finite structural thickness of the continuous walls of the shell define therein a cavity 11 which is substantially filled with insulation material 13. The shape of cavity 11 formed is generally that of a double joined "L" or, in other words a "Z" whose top and base legs exceed the limits of the Z. This configuration enables the blocks, when assembled to form a wall to present a continuous insulation effect, as defined above, simply by insuring that the distance of offset "d" is greater than the combined thickness of two walls 5a or 5b and one wall 7a or 7b.

The shell 1 may be formed of any conventional or known building block material such as cement cinder block or mortar block in foamed or solid form. The shell 1 may be formed by conventional rough molding techniques so as to require mortar at their joints. In other embodiments, shells 1 may be formed by never known techniques which precision form the shells of such precise dimensions that they fit very tightly together when stacked. Such blocks may be joined by using epoxy at the joints or the blocks can be held together by the cavity insulation when such constitutes an adhesive which is formed in situ in the blocks.

Conventional insulation 13 may be used to fill cavity 11, such as vermiculite, fiberglass, asbestos, polystyrene, urethane, styrofoam, urea-formaldehyde, epoxy or the like. As discussed above, the insulation material may also be an adhesive such as an epoxy. In such a situation, when it sets, because of the column formed when stacking the blocks so that vertically abutting blocks have their cavities 11 aligned, it may serve as a reinforcing structure by itself or with the help of vertical reinforcing bars 15 shown in FIG. 3 inserted therein. Groove 17 may be provided for horizontal reinforcing bar 19 if deemed appropriate. Generally speaking the block should be of a sufficient strength in p.s.i. and stress so as to pass local building code requirements (e.g., ICBO Code, BOCA Code, HUD Code). In addition the block should have an insulating "R" factor of about 0.19 or better.

A typical example of a block construction according to this invention is to form shell 1 of a cement cinder combination to meet local code requirements and to fill cavity 13 with a conventional urea-formaldehyde insulating resin which foams and solidifies in situ. The outer dimensions of shell 1 are typically an overal dimension of 20 × 8 × 8" with widths $w_1$,$w_2$,$w_3$, and distance "d" being 4", thus leaving face walls 3a and 3b of 16" in length and 8" in height. In such a configuration the thickness of walls 3a and 3b may be about $1\frac{1}{4}$–$1\frac{3}{8}$" while walls 5,7 and 9 may be about $\frac{3}{4}$". The dimensions of the blocks may be varied over a wide range to meet specific situations.

Figure 2:
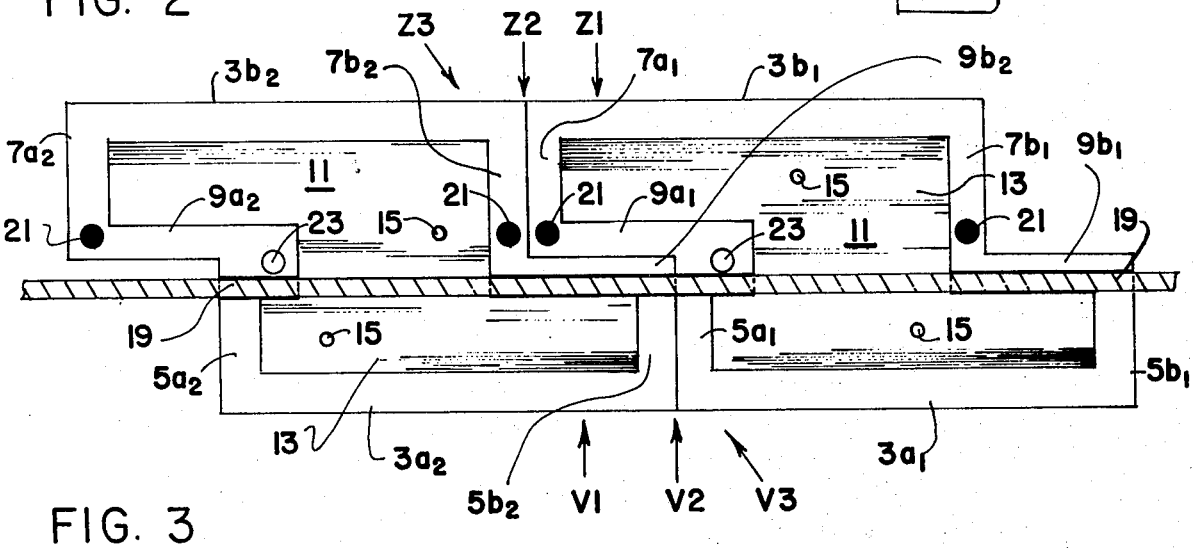
FIG. 2 is a top plan view of two blocks of FIG. 1 assembled together.
Figure 3:
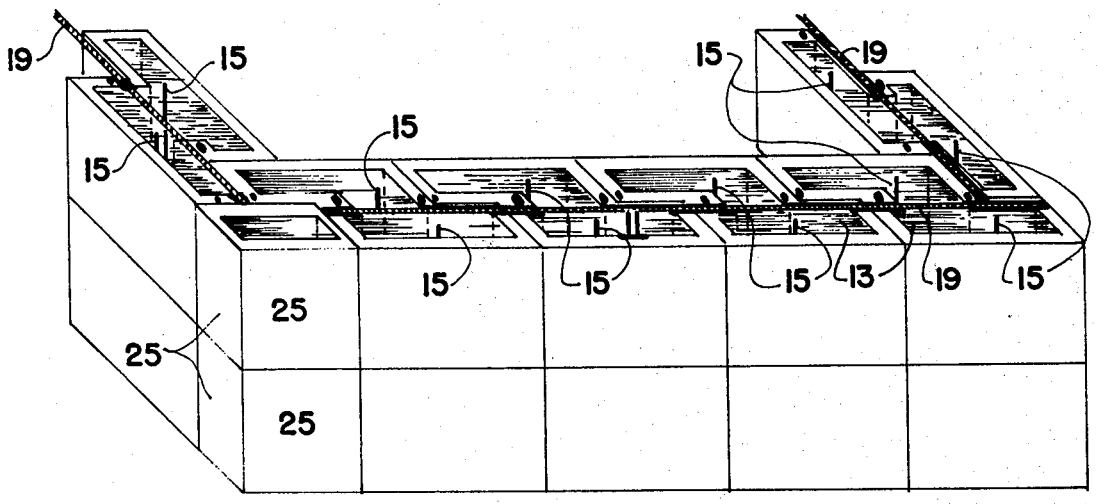
FIG. 3 is a perspective view of a wall formed of the blocks of FIG. 1.

With reference to FIGS. 2–3, the blocks of this invention are readily formed into tight fitting walls of considerable strength and which exhibit a continuous insulating effect as defined above. In such an embodiment, side walls 3a and 3b form the face walls of the construction while end walls 5a, 5b and 7a, 7b are walls which abut like walls of adjacent blocks. Reference to energy force vectors $V_1$, $V_2$, $V_3$ and $Z_1$, $Z_2$ and $Z_3$ (FIG. 2) shows this to be the case. Because of the overlap in insulation between abutting blocks due to offset distance "d" being greater than the sum of the thickness of walls 5a, $5a_2$ and 7a, or $7a_2$, a "continuous" insulation front is presented to any straight energy force line seeking to penetrate the wall at any angle. The only energy that can avoid the insulation is a conduction force vector that could meander the curving course along the abutting walls of the blocks. Energy loss is minimal but can be even further reduced by using precision blocks, insulating joint adhesive and if desired, providing an orifice 21 extending through an abutting wall, such as at the corner of walls 7a and 9a and at the corner of walls 7b and 9b. Orifice 21 can be filled with insulation similar to insulation material 13.

To reinforce the walls, and/or as an easy mounting technique for rapid assembly of a wall construction, the corner of walls 9a and 5a may be enlarged to provide for orifice 23. The corner of walls 9b and 5b could also be so provided, or could be used in lieu of the corner of 9a and 5a, as could any other convenient location along the walls. Orifice 23 extends through shell 1 from top to bottom. Thus reinforcing and/or aligning bar may be inserted into the blocks either after stacking or preferably to assist stacking. In certain embodiments the entire wall without insulation, or a portion thereof, may be constructed using the aligning bars, and the cavities 11 may be filled all at once after the blocks are so stacked. A very rapid construction of the wall is achieved, particularly if the insulation is also an adhesive and no further joint adhesive or mortar is necessary. As shown in FIG. 3, square, insulated (or optionally, uninsulated) corner blocks 25 may be used to finish off the walls at the corner.

Figure 4:
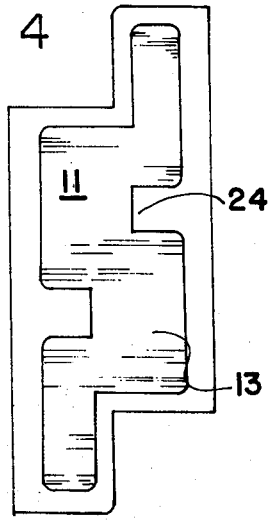
FIG. 4 is a top plan view of another embodiment of a block according to this invention.

FIG. 4 illustrates another block in accordance with this invention. The block illustrated is useful when staggered stacking of the blocks is desired, rather than the "directly over" or "in-line" stacking illustrated in FIG. 3. In such an embodiment, stagger studs 24 are molded integrally into the walls of the block to provide a resting support for the end walls of the block above and/or below. In all other respects the block may be similar to that illustrated in FIG. 1, or as illustrated may have eliminated therefrom the various reinforcing bar and insulation orifices and may have face walls thicker than the end walls.

Once given this disclosure many other features, modifications and improvements will become apparent to the skilled artisan. Such other features, modifications and improvements are considered a part of this invention, the scope of which is to be determined by the following claims.

I claim:

1. A building block comprising a walled shell of finite thickness thereby defining a continuous cavity therewithin, the inner surface of said walled shell including a continuum of at least eight sides, two of said sides comprising a pair of laterally spaced opposing faces offset longitudinally one from the other, four of said sides comprising 2 pairs of adjacent ends connected to the 4 extremities of said faces, and two of said sides forming a joinder connecting each pair of adjacent ends, the outer surface of said walled shell including at least eight sides adjacent to and extending in substantially the same direction as their respective inner sides thereby to form a hollow block in which the continuous cavity and outer surface are of a generally offset shape, the amount of offset and thickness of the walls being such that when the cavity is filled with insulation and an offset end is matingly abutted with the offset end of a similar block, the structure so formed will have an overlapping cavity arrangement such that any straight vector heat flow striking the structure will always meet insulation regardless of what point on the structure the vector seeks to go through in a straight line.

2. A building block according to claim 1 wherein the outer surface of said walled shell is defined by a continuum of said at least eight sides, said outer eight sides being substantially parallel with said inner eight sides.

3. A building block according to claim 1 wherein at least one of said sides of said inner surface has projecting inwardly therefrom into said cavity a support member, said support member being integral with said inner surface.

4. A building block according to claim 1 in which said cavity is filled with insulation.

5. A building block according to claim 1 wherein said offset forms an opposing "L" shaped inset at either end of said block thereby to form an inner and outer surface of substantially "Z" shape wherein the top and bottom legs of the "Z" extend beyond its confines.

6. A building block according to claim 5 wherein the legs of said "L" are substantially of the same length and are substantially perpendicular one to the other.

7. A building block according to claim 1 wherein the end walls are substantially thinner than the face walls.

8. A building block according to claim 4 wherein said block is open at its top and bottom sides.

9. A building block according to claim 4 wherein said insulation is an in situ foamed plastic.

10. A building block according to claim 4 wherein the shell defines a shell cavity in the general shape of a "Z" wherein the legs of the "Z" exceed the normal confines thereof, thus to define an offset area of insulation capable of overlapping in the longitudinal direction from a lateral view with the offset area of a similar block in longitudinal abutment therewith.

11. A building block according to claim 8 wherein, in one of said walls there is provided an orifice means extending from the top to bottom side of said block for retaining an aligning or reinforcing rod therein.

12. A building block according to claim 11 wherein said orifice is provided in an enlarged extension of the connection between a joining wall and its innermost end wall.

13. A building block according to claim 12 wherein said orifice is provided in an enlarged extension of the connection between each of said joining walls and its innermost end wall.

14. A wall construction having a continuous insulation effect comprised of a plurality of blocks of claim 4.

15. A wall construction having a continuous insulation effect comprised a plurality of blocks of claim 8.

16. A wall construction having a continuous insulation effect comprised of a plurality of blocks of claim 11, wherein said blocks are aligned by a rod located in said orifice means and extending between the orifice means of one block and the orifice means of the next proximal block.

17. A wall construction having a continuous insulation effect comprised of a plurality of blocks of claim 10 connected such that their respective offsets abut in mating fashion.

18. A wall construction according to claim 17 wherein an abutting end wall of each block has located therein an orifice extending therethrough filled with insulation material.

19. A wall construction having a continuous insulation effect comprised of a plurality of blocks of claim 17 wherein the ends of the blocks forming one row are supported by respective support members of the blocks of the proximal row.

20. a method of constructing the wall construction of claim 16 comprising forming a bottom row of said blocks unfilled with insulation material, said blocks having upwardly extending from said orifice means aligning rods, stacking another row of blocks unfilled with insulation material on said first row by inserting said aligning rods in their respective orifice means, the unfilled stacked blocks having aligned cavities, and thereafter filling said aligned cavities with insulation material.

21. A method according to claim 20 which further includes inserting a reinforcing rod in said cavities.

22. A method according to claim 20 which further includes providing reinforcing rods along the length of at least one row before stacking another row thereupon.

23. A method according to claim 20 wherein said insulation material used to fill said cavities is also an adhesive for said blocks, and no joint adhesive material is used to join the blocks during stacking.

* * * * *